US011688986B2

(12) United States Patent
Imamura et al.

(10) Patent No.: US 11,688,986 B2
(45) Date of Patent: Jun. 27, 2023

(54) SLIP RING WITH MULTIPLE DIFFERENTIAL SIGNAL SLIP RINGS FOR FULL HIGH DEFINITION SIGNAL TRANSMISSION

(71) Applicant: TSUBAME RADIO CO., LTD, Maebashi (JP)

(72) Inventors: Masao Imamura, Maebashi (JP); Hiroshi Iwata, Maebashi (JP)

(73) Assignee: TSUBAME RADIO CO., LTD

( * ) Notice: Subject to any disclaimer, the term of this patent is extended or adjusted under 35 U.S.C. 154(b) by 155 days.

(21) Appl. No.: 17/441,288

(22) PCT Filed: Apr. 27, 2020

(86) PCT No.: PCT/JP2020/017939
§ 371 (c)(1),
(2) Date: Sep. 21, 2021

(87) PCT Pub. No.: WO2021/220332
PCT Pub. Date: Apr. 11, 2021

(65) Prior Publication Data

US 2022/0302663 A1 Sep. 22, 2022

(51) Int. Cl.
*H01R 39/10* (2006.01)

(52) U.S. Cl.
CPC ..... *H01R 39/10* (2013.01); *H01R 2201/18* (2013.01)

(58) Field of Classification Search
CPC ..... H01R 39/10; H01R 2201/18
See application file for complete search history.

(56) References Cited

U.S. PATENT DOCUMENTS

| | | | |
|---|---|---|---|
| 2003/0103770 | A1 | 6/2003 | Arbuckle |
| 2007/0182827 | A1 | 8/2007 | Sassa |
| 2018/0063432 | A1 | 3/2018 | Wada et al. |

FOREIGN PATENT DOCUMENTS

| | | | | |
|---|---|---|---|---|
| CN | 207165893 | U | * | 3/2018 |
| JP | S63-131086 | U | | 8/1988 |
| JP | H09-16284 | A | | 1/1997 |
| JP | H09-284612 | A | | 10/1997 |
| JP | 2007-201576 | A | | 8/2007 |
| JP | 2016-66512 | A | | 4/2016 |
| JP | 2016066512 | A | * | 4/2016 |
| JP | 2016-181768 | A | | 10/2016 |
| JP | 6128718 | B | | 5/2017 |
| JP | 2017188363 | A | * | 10/2017 |
| JP | 2018085175 | A | * | 5/2018 |

OTHER PUBLICATIONS

CN207165893U English translation (Year: 2023).*
JP2016066512A English translation (Year: 2023).*
JP2018085175A English translation (Year: 2023).*
JP2017188363A English translation (Year: 2023).*

* cited by examiner

*Primary Examiner* — Christopher M Koehler
*Assistant Examiner* — Viswanathan Subramanian
(74) *Attorney, Agent, or Firm* — Yokoi & Co., U.S.A.; Toshiyuki Yokoi

(57) ABSTRACT

In a slip ring 100, differential signal slip rings 70 are formed using a base substrate 30 where an electrode pattern and a relative permittivity are optimized to transmit a signal by using one differential signal slip ring 70 to one differential signal cable 60*a*. Consequently, a low voltage differential signal of 0.35V adopted in video signals of 4K resolution can be transmitted while the camera is continuously rotated through 360 degrees.

6 Claims, 13 Drawing Sheets

SLIP RING WITH MULTIPLE DIFFERENTIAL SIGNAL SLIP RINGS FOR FULL HIGH DEFINITION SIGNAL TRANSMISSION

TECHNICAL FIELD

The present invention relates to a slip ring capable of transmitting low voltage differential signals.

BACKGROUND ART

A mechanical equipment having a rotation mechanism is frequently used for an industrial robot, a carrier device, a game machine, a universal head of a monitoring camera and other devices. In the mechanical equipment having the rotation mechanism, electric power is supplied and signals are transmitted between a stationary portion and a rotary portion in many cases. In particular, when the rotary portion is continuously rotated, it is general to electrically connect the stationary portion and the rotary portion to each other by using a slip ring. When the connection is made by using the slip ring, an electric wiring connected from the stationary portion is connected to an electric wiring connected from the rotary portion by using contact conduction. As a result, the handling of the cables is not required at the rotated part. Thus, the rotational motion can be performed with high flexibility.

Due to heightened awareness of security in recent years, the demand for high-resolution has been increased in addition to the demand for pan-tilt-zoom in the field of the monitoring camera (security camera). In order to increase the resolution of the monitoring camera, the signals should be transmitted at high speed with high density. Therefore, the slip ring capable of transmitting high-frequency signal is desired to be developed. For satisfying the above described demand, the inventors of the present invention developed the invention related to the slip ring capable of transmitting the high-frequency signal of Full High Definition using HD-SDI format or 3G-SDI format as described in Patent Document 1 below.

PRIOR ART DOCUMENTS

Patent Documents

Patent Document 1: Japanese Patent No. 6128718

DISCLOSURE OF THE INVENTION

Problems to be Solved by the Invention

Meanwhile, a camera having 4K resolution (3840×2160 pixels) has been put into practical use as a higher resolution camera in recent years. The digital transmission system called LVDS (Low Voltage Differential Signal System) using 0.35V is adopted for transmitting the video signals of 4K resolution. However, reflection and attenuation of signals are large in the slip ring described in Patent Document 1. Thus, the slip ring described in Patent Document 1 is not compatible with the low voltage differential signal of 4K resolution.

The present invention is made considering the above described situation and aims for providing the slip ring capable of transmitting the low voltage differential signal of 4K resolution.

Means for Solving the Problem (1) The present invention solves the above described problem by providing a slip ring 100 installed between a rotary equipment 3 and a stationary portion 1, the slip ring 100 including: a rotary shaft 72 fixed to the rotary equipment 3 at one end of the rotary shaft 72; and four differential signal slip rings 70, the rotary shaft 72 being inserted through the slip rings 70, wherein each of the differential signal slip rings 70 includes: a rotor 40 configured to be rotated by the rotary shaft 72, the rotor 40 having a pair of differential signal sliders 50*a* and two shielding sliders 50*b*; and a base substrate 30 having a pair of annular electrodes 32 formed concentrically with a rotation axis of the rotor 40, a first shield electrode 31*a* formed on an inner peripheral side than the annular electrodes 32 and a second shield electrode 31*b* formed on an outer peripheral side than the annular electrodes 32, a pair of differential signal lines 60*a*(+), 60*a*(−) of differential signal cables 60*a* connected from the rotary equipment 3 are electrically connected to the pair of differential signal sliders 50*a*, shield wires 60*a*(G) of the differential signal lines 60*a*(+), 60*a*(−) are electrically connected to the shielding sliders 50*b*, a pair of differential signal lines 60*b*(+), 60*b*(−) of differential signal cables 60*b* connected from the stationary portion 1 are electrically connected to the pair of annular electrodes 32, shield wires 60*b*(G) of the differential signal lines 60*b*(+), 60*b*(−) which are connected to the annular electrodes 32 are electrically connected to the first shield electrode 31*a* and the second shield electrode 31*b*, and the pair of differential signal sliders 50*a* is configured to be electrically connected to the pair of annular electrodes 32 and the shielding sliders 50*b* are configured to be electrically connected to the first and second shield electrodes 31*a*, 31*b* so that a differential signal of one of the differential signal cables 60*a* is transmitted via one of the differential signal slip rings 70.

(2) The present invention solves the above described problem by providing the slip ring 100 according to (1) described above, wherein a cable through-hole 48 is provided in a shaft hole 44 of the rotation axis of the rotor 40, the differential signal cables 60*a* connected from the rotary equipment 3 are led in the rotor 40 through an inside of the rotary shaft 72 and the cable through-hole 48, and the differential signal cables 60*a* are connected to the differential signal sliders 50*a* and the shielding sliders 50*b*.

(3) The present invention solves the above described problem by providing the slip ring 100 according to (2) described above, wherein an opening window 64 for exposing sliding portions 52*a* of the differential signal sliders 50*a* and the shielding sliders 50*b*; and a cable cover 62 fixed to the rotor 40 for preventing the differential signal cables 60*a* from contacting the base substrate 30 are further provided.

(4) The present invention solves the above described problem by providing the slip ring 100 according to (1) described above, wherein when an interval L2 is defined as the interval between the annular electrodes 32 and an interval L3 is defined as the interval between one of the annular electrodes 32 formed on the inner peripheral side and the first shield electrode 31*a* formed on the inner peripheral side or the interval between the other of the annular electrodes 32 formed on the outer peripheral side and the second shield electrode 31*b* formed on the outer peripheral side, the interval L3 is three times longer than the interval L2.

(5) The present invention solves the above described problem by providing the slip ring 100 according to (1) described above, wherein the second shield electrode 31*b* covers a blank space of the base substrate 30 approximately entirely, a third shield electrode 31*c* covering a reverse surface of the base substrate 30 approximately entirely is provided, and the second shield electrode 31*b* and the first shield electrode 31*a* are connected to the third shield electrode 31*c*.

(6) The present invention solves the above described problem by providing the slip ring 100 according to any one of (1) to (5) described above, wherein a general signal slip ring 90 having a general signal rotor 40' rotated by the rotary shaft 72 is further provided.

Effects of the Invention

The slip ring of the present invention can transfer the low voltage differential signal of 0.35V adopted in the video signals of 4K resolution.

MODES FOR CARRYING OUT THE INVENTION

Figure 1:
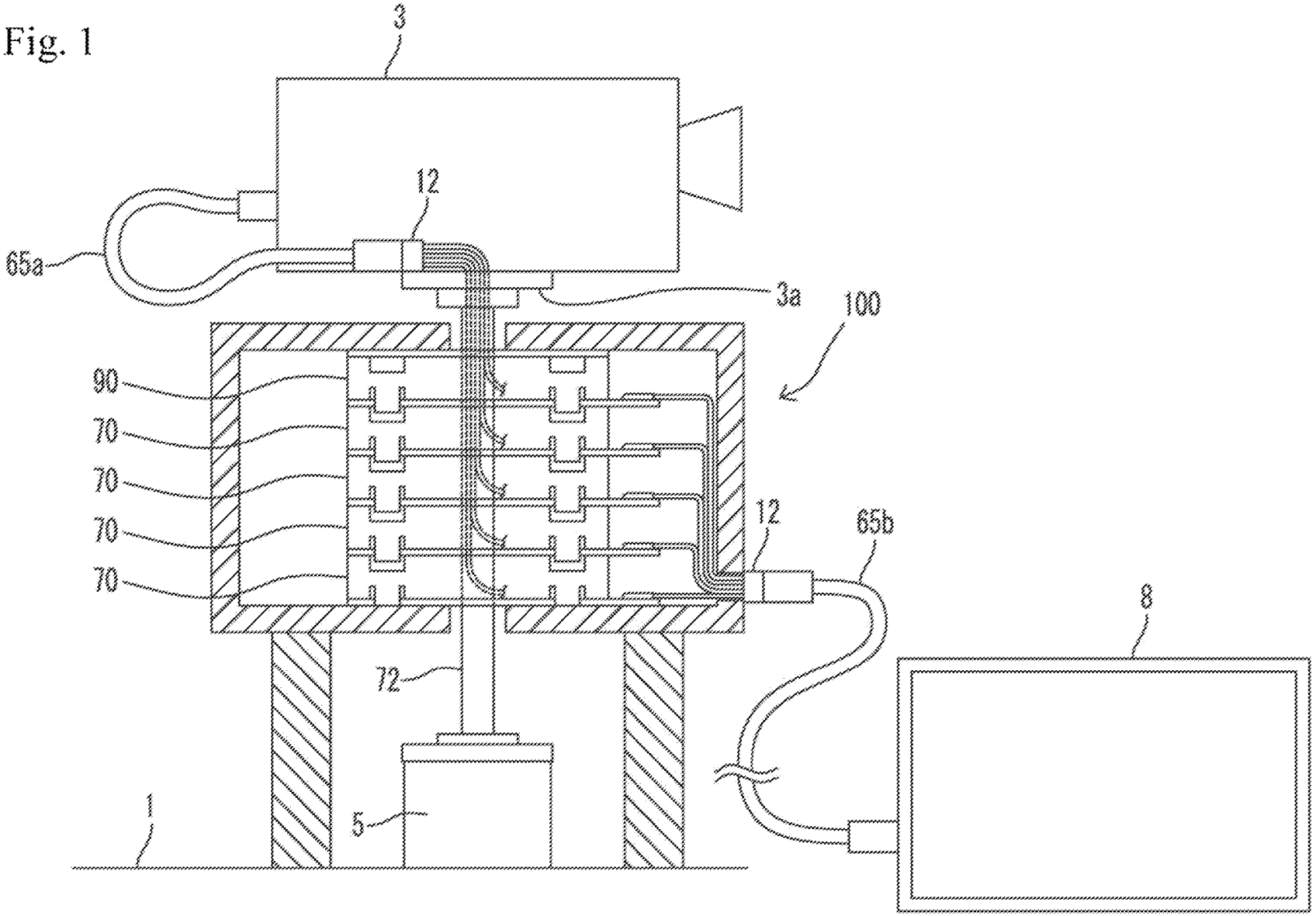
FIG. 1 is a schematic configuration diagram showing a use state of a slip ring concerning the present invention.

Embodiments of a slip ring 100 of the present invention will be explained based on the drawings. First, as shown in FIG. 1, the slip ring 100 of the present invention is installed between a rotary equipment (rotator, rotary portion) 3 and a stationary portion (stator) 1. The slip ring 100 includes a rotary shaft 72, four differential signal slip rings 70 installed on the rotary shaft 72, and a general signal slip ring 90 also installed on the rotary shaft 72. Note that the general signal slip ring 90 may be formed separately from the slip ring 100. The differential signal slip rings 70 can transmit at least the low voltage differential signal of 0.35V which is the video signals of 4K resolution. Each of the differential signal slip rings 70 includes: a rotor 40 having differential signal sliders 50*a* and shielding sliders 50*b*; a case portion 20 for rotatably housing the rotor 40; and a base substrate 30. The general signal slip ring 90 is a well-known slip ring capable of transmitting power supply lines and conventional electrical signals. The general signal slip ring 90 includes: a general signal rotor 40' having sliders 50; a case portion 20 for rotatably housing the general signal rotor 40'; and a general signal base substrate 30'. The configuration of the above described components will be explained in more detail later.

The rotary shaft 72 is fixed to the rotary equipment 3 at one end of the rotary shaft 72 via a mounting stay 3*a* such as a universal head, for example. In addition, the other end of the rotary shaft 72 is connected to a rotary means 5 of the stationary portion 1 side. Note that the rotary equipment 3 here is the device for transmitting the data through the low voltage differential signal. For example, the rotary equipment 3 may be a monitoring camera and an IP camera of 4K resolution. The rotary means 5 here may be a well-known rotation mechanism such as a motor. A device 8 is provided on the stationary portion 1 side for acquiring the data transmitted from the rotary equipment 3 to perform a predetermined processing. Note that the device 8 here may be a monitor for reproducing the images (videos) photographed by the rotary equipment 3 (monitoring camera), a recorder (storage device) such as a hard disk for recording the images, an image analysis device for performing well-known image analysis such as face recognition, for example. The rotary equipment 3 and the device 8 are connected to each other by signal cables 65*a*, 65*b* via the slip ring 100 of the present invention. When the rotary means 5 is rotated, the rotary shaft 72 is rotated. Thus, the rotary equipment 3 continuously performs a rotational operation through 360 degrees while keeping the signal transmission through the signal cables 65*a*, 65*b*.

Figure 2:
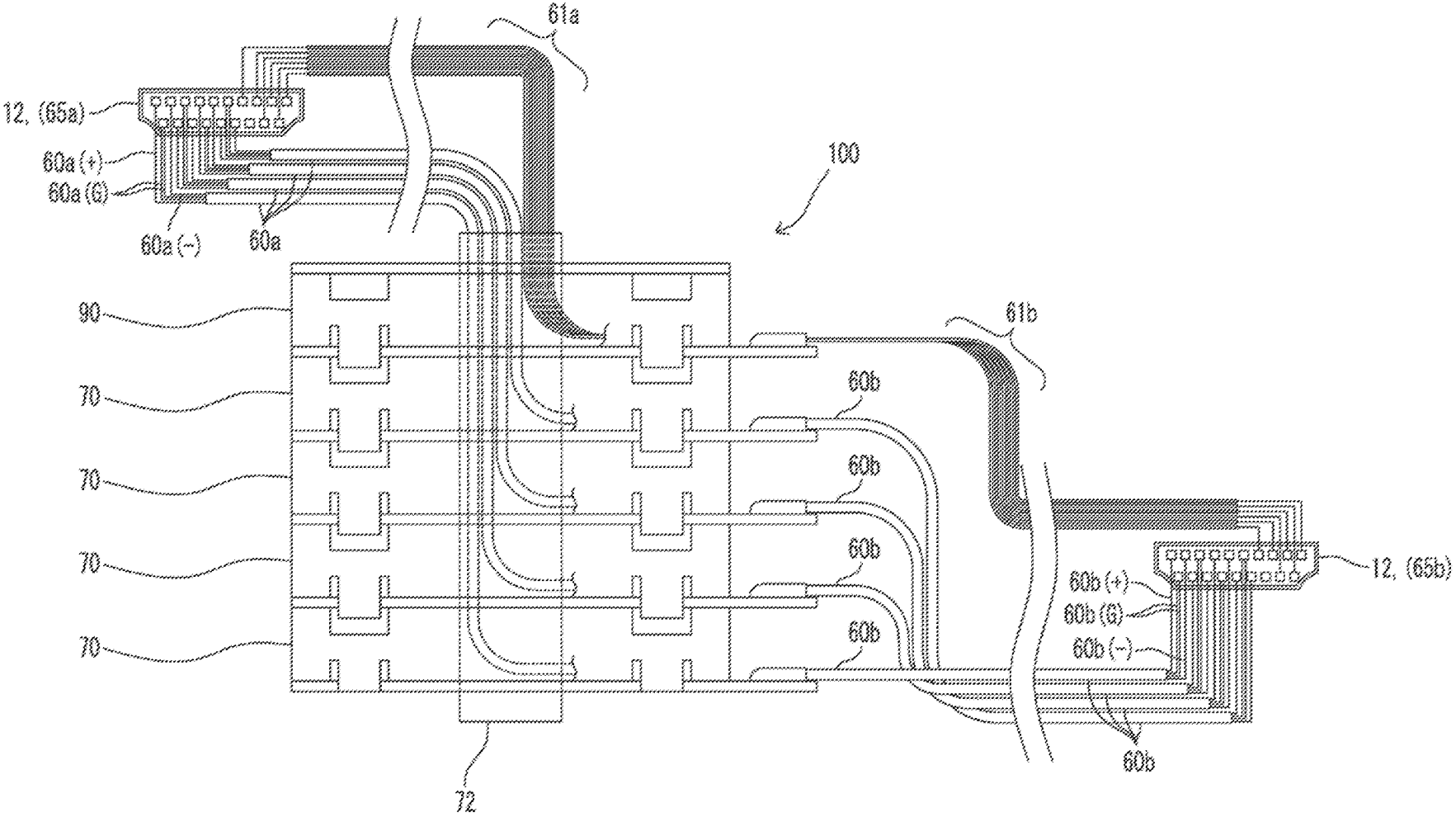
FIG. 2 is a drawing for explaining a cable connection of the slip ring concerning the present invention.

For example, when the signal cables 65*a*, 65*b* are HDMI (registered trademark) cables, the signal cables 65*a*, 65*b* are composed of four (R, B and Clock) differential signal cables and six general signal cables for the power supply line and the operation signals. In one of the differential signal cables, shield wires and a pair of (positive and negative) differential signal lines are included. For example, connection terminals 12 are provided on the slip ring 100 at the rotary equipment 3 side and the stationary portion 1 side. As shown in FIG. 2, at the connection terminal 12 of the rotary equipment 3 side, positive terminals of the differential signal lines of the signal cables 65*a* are respectively connected to the positive terminals of the differential signal line 60*a*(+) of differential signal cables 60*a* of the slip ring 100 side. In addition, the negative terminals of the differential signal line of the differential signal cables of the signal cables 65*a* are respectively connected to the negative terminals of the differential signal line 60*a*(−) of the differential signal cables 60*a* of the slip ring 100 side. Furthermore, the terminals of the shield wires of the differential signal cables of the signal cables 65*a* are respectively connected to two shield wires 60*a*(G) of the differential signal cables 60*a* of the slip ring 100 side. Each of the four differential signal cables 60*a* is connected to each of the differential signal slip rings 70. In addition, each of the differential signal slip rings 70 is connected to each of differential signal cables 60*b* connected from the stationary portion 1 side. At the connection terminal 12 of the stationary portion 1 side, the positive terminals of the differential signal line 60*b*(+) of the differential signal cables 60*b* are respectively connected to the positive terminals of the differential signal line of the differential signal cables of the signal cables 65*b* of the device 8 side. In addition, the negative terminals of the differential signal line 60*b*(−) of the differential signal cables 60*b* are respectively connected to negative terminals of the differential signal line of the differential signal cables of the signal cables 65*b* of the device 8 side. Furthermore, two shield wires 60*b*(G) of the differential signal cables 60*b* are respectively connected to the terminals of the shield wires of the differential signal cables of the signal cables 65*b* of the device 8 side.

The general signal cables of the signal cables 65*a* are respectively connected to general signal cables 61*a* of the slip ring 100 through the connection terminal 12, for example. Thus, the general signal cables 61*a* are connected to the general signal slip ring 90. The general signal slip ring 90 is connected to general signal cables 61*b* connected from the stationary portion 1 side. The general signal cables 61*b* are respectively connected to the terminals of the general signal cables of the signal cables 65*b* through the connection terminal 12, for example.

Consequently, the differential signal lines of the signal cables 65*a* connected from the rotary equipment 3 are connected to the device 8 via the differential signal cables 60*a*, the differential signal slip rings 70, the differential signal cables 60*b* and the signal cables 65*b*. In addition, the general signal lines of the signal cables 65*a* connected from the rotary equipment 3 are connected to the device 8 via the general signal cables 61*a*, the general signal slip ring 90, the general signal cables 61*b* and the signal cables 65*b*.

Next, the configuration of each component of the slip ring 100 of the present invention will be explained. The case portion 20, the rotor body portion 41, the sliders 50, 50*a*, 50*b* are made common between the differential signal slip rings 70 and the general signal slip ring 90 in the example shown below. However, it is not necessary to limit the configuration to this example. It is also possible to use the components made independently for the differential signal slip rings 70 and the general signal slip ring 90. However, the cost of the components can be expected to be reduced by communalizing the above described components.

Figure 3:
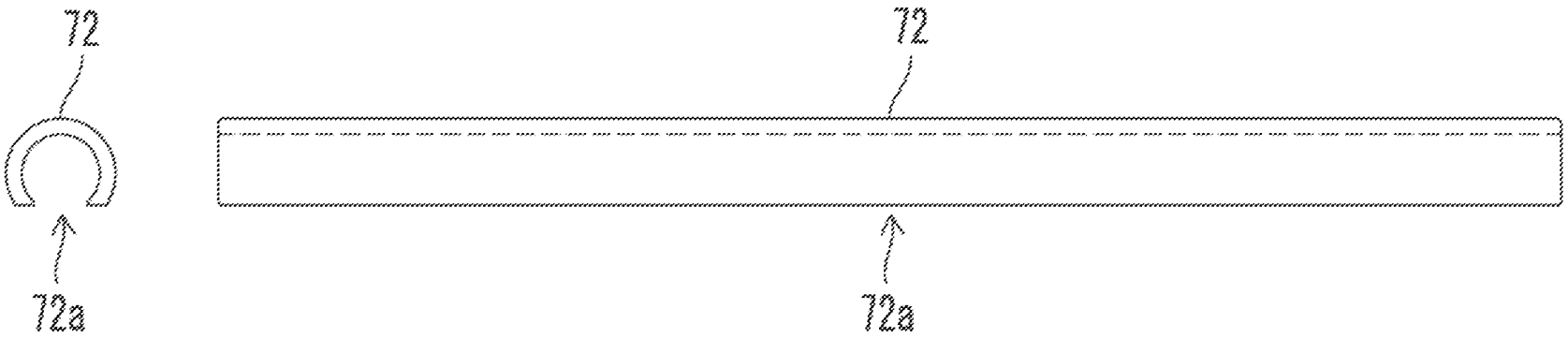
FIG. 3 is a drawing for explaining a rotary shaft of the slip ring concerning the present invention.

As shown in FIG. 3, a cylindrical pipe having a circular arc cross section is preferably used for the rotary shaft 72 of the present invention where the cylindrical pipe is partially notched to form an opening 72*a*. The differential signal cables 60*a* and the general signal cables 61*a* connected from the rotary equipment 3 side are preferably led in the differential signal slip rings 70 and the general signal slip ring 90 through an inside of the rotary shaft 72.

Figure 4B:
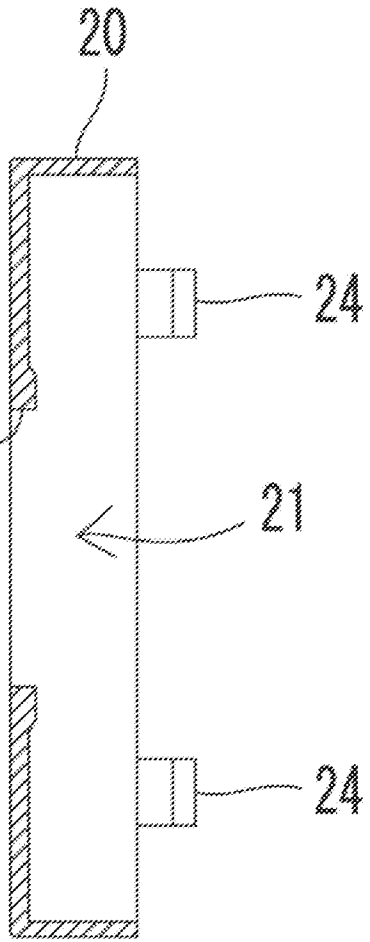
FIGS. 4A and 4B are drawings for explaining a case portion of the slip ring concerning the present invention.
Figure 4A:
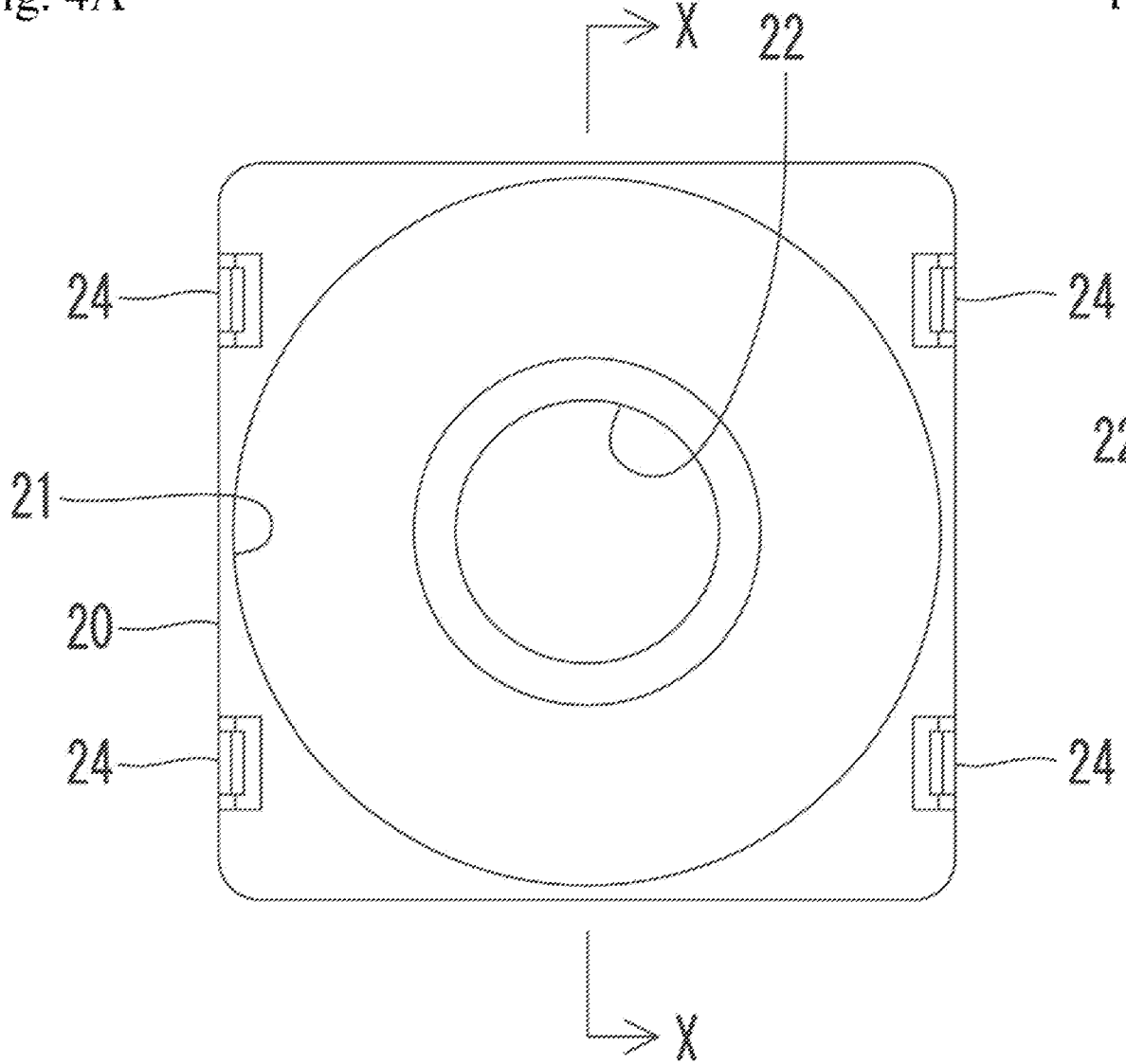

Next, the configuration of the differential signal slip rings 70 and the general signal slip ring 90 will be explained. The case portion 20 of the differential signal slip rings 70 and the general signal slip ring 90 is made of a synthetic resin manufactured by molding, for example. As shown in FIG. 4A and the X-X cross-sectional view shown in FIG. 4B, the case portion 20 includes a rotor housing portion 21 for rotatably housing the rotor 40, 40'. A rotor bearing 22 is formed on the bottom portion of the rotor housing portion 21 to function as a bearing of the rotor 40, 40'. The lateral face of the case portion 20 is provided with fitting means 24 for holding the base substrates 30, 30' and fitting the case portion 20 to another case portion 20 in a longitudinal direction.

Figure 5B:
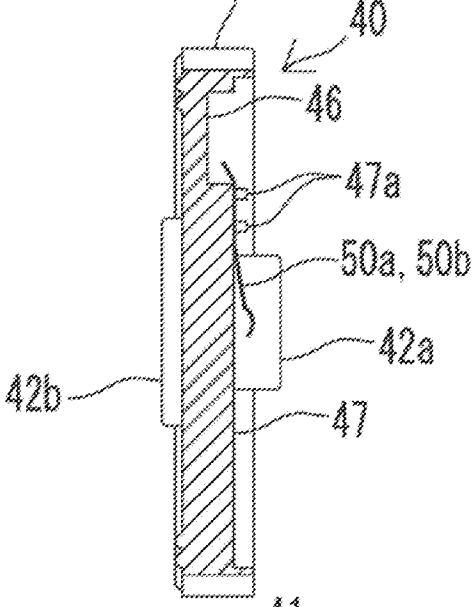
FIGS. 5A to 5C are drawings for explaining a rotor of differential signal slip ring constituting the present invention.
Figure 5C:
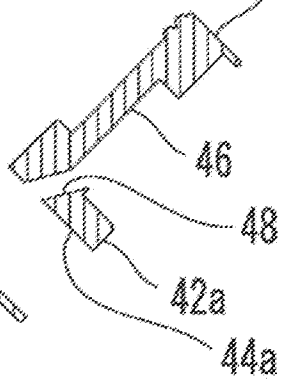
Figure 5C:
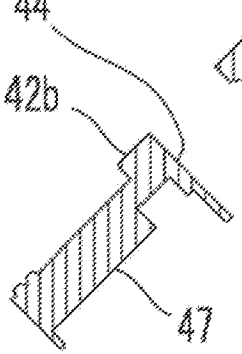
Figure 5A:
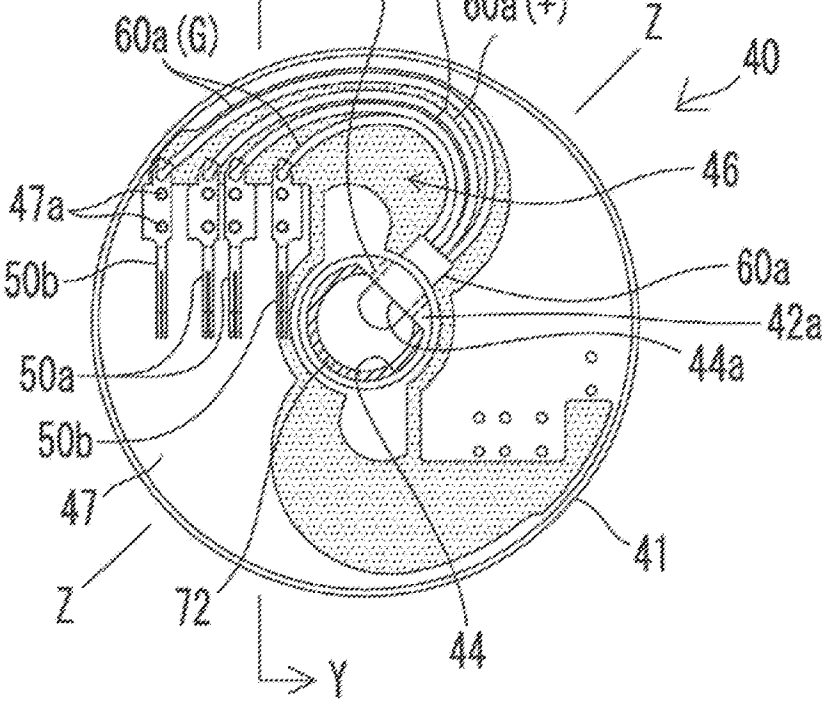
Figure 6:
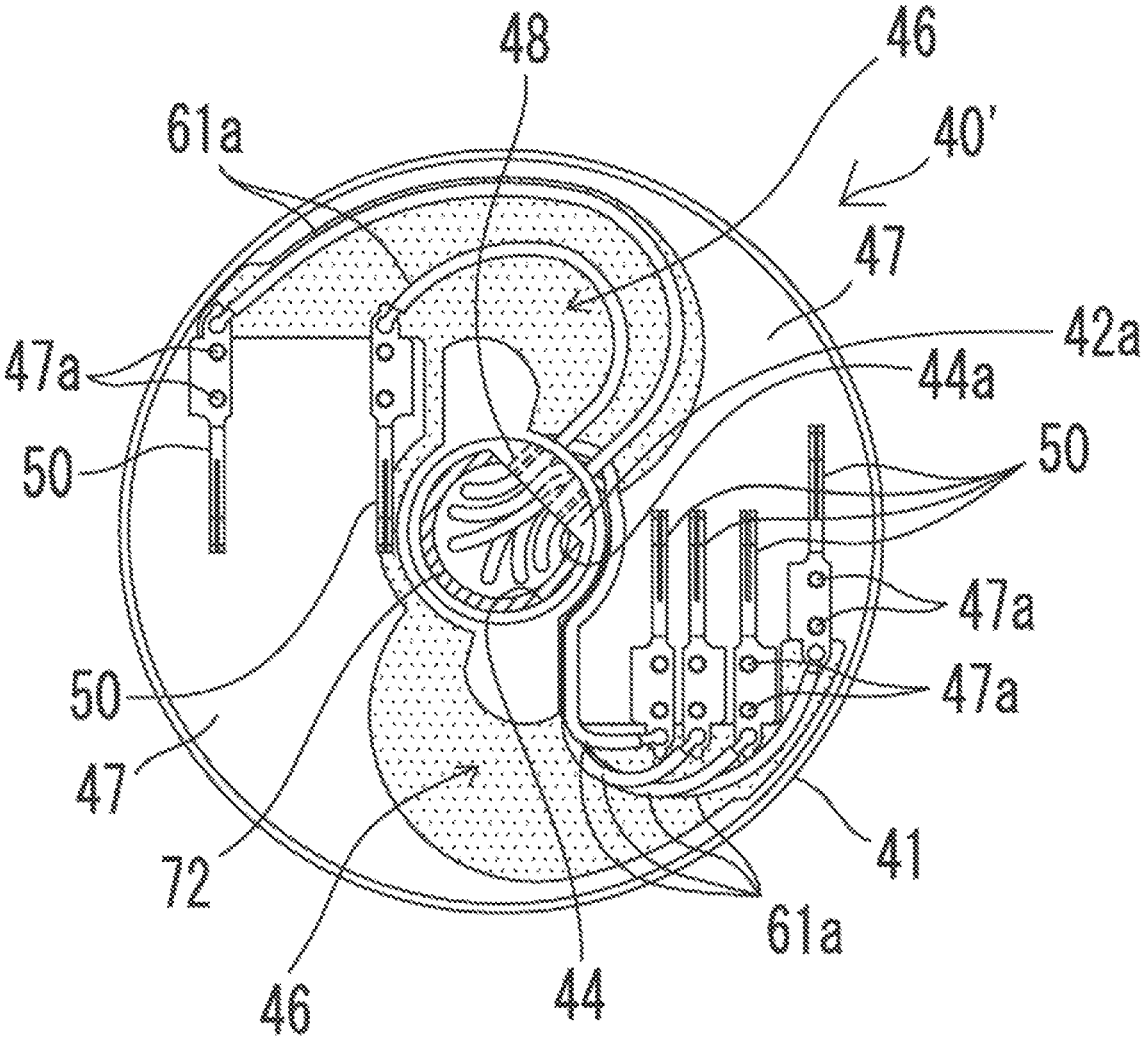
FIG. 6 is a drawing for explaining a rotor of a general signal slip ring constituting the present invention.

Next, the rotor 40 of the differential signal slip rings 70 and the general signal rotor 40' of the general signal slip ring 90 will be explained. FIG. 5A is a drawing showing the rotor 40 of the differential signal slip rings 70 at a surface facing the base substrate 30. FIG. 5B is a schematic-cross sectional view of the rotor 40 cut along a Y-Y plane, and FIG. 5C is a schematic-cross sectional view of the rotor body portion 41 cut along a Z-Z plane. FIG. 6 is a drawing showing the general signal rotor 40' of the general signal slip ring 90 at a surface facing the general signal base substrate 30'.

Each of the rotor 40 and the general signal rotor 40' shown in FIGS. 5A-5C and FIG. 6 has the rotor body portion 41 made of a synthetic resin manufactured by molding, for example.

The rotor body portion 41 has the shaft hole 44 (rotation axis) provided with a rotation preventing piece 44*a* at a central part. The rotor body portion 41 is made common between the differential signal slip rings 70 and the general signal slip ring 90 in this example as described above. However, the rotor body portion 41 having individual shape can be used in each slip ring. Cylindrical shafts 42*a*, 42*b* of the shaft hole 44 are formed to be protruded from both the front and back surfaces of the rotor body portion 41. The cylindrical shaft 42*b* is rotatably supported by the rotor bearing 22 of the case portion 20. The cylindrical shaft 42*a* is rotatably supported by a later described rotor hole 36 of the base substrate 30 and the general signal base substrate 30'. The rotary shaft 72 is inserted into (inserted through) the rotor 40 and the general signal rotor 40' in a state that the opening 72*a* of the rotary shaft 72 is in contact with the rotation preventing piece 44*a* of the shaft hole 44. Thus, the rotor 40 and the general signal rotor 40' are rotated together with the rotary shaft 72. The rotor body portion 41 is recessed in two steps from the base substrate side. A slider fixing means 47*a* is formed on a shallow part located at the first step. Note that any configurations can be used for the slider fixing means 47*a* as long as slider fixing means 47*a* can fix the sliders 50. It is preferable that the slider fixing means 47*a* is formed as a protrusion as shown in the drawing, a fixing hole 52*c* of the sliders 50 are inserted around the protrusion and the sliders 50 are fixed by adhesion or thermal caulking, for example. A deep part (dot area in FIG. 5A and FIG. 6) located at the second step functions as a cable housing portion 46 for housing the differential signal cables 60*a* or the general signal cables 61*a* connected from the rotary shaft 72. A cable through-hole 48 passing from the shaft hole 44 to the cable housing portion 46 is provided in the rotation preventing piece 44*a* of the shaft hole 44. The differential signal cables 60*a* or the general signal cables 61*a* housed in the rotary shaft 72 are led in the cable housing portion 46 through the cable through-hole 48.

As shown in FIG. 5A, a pair of differential signal sliders 50*a* for transmitting a differential signal and shielding sliders 50*b* located at both sides (i.e., one is located at an inner peripheral side and the other is located at an outer peripheral side) of the differential signal sliders 50*a* are installed on the slider fixing means 47*a* of the rotor 40. In the differential signal cables 60*a* led in the cable housing portion 46, the positive differential signal line 60*a*(+) and the negative differential signal line 60*a*(−) are respectively connected to corresponding differential signal sliders 50*a*. In addition, the shield wires 60*a*(G) of the differential signal cables 60*a* are respectively connected to the shielding sliders 50*b*. Consequently, the differential signal lines of the rotary equipment 3 side are electrically connected to the differential signal sliders 50*a* of the differential signal slip rings 70. In addition, the shield wires of the rotary equipment 3 side are electrically connected to the shielding sliders 50*b* of the differential signal slip rings 70

In the general signal rotor 40', as shown in FIG. 6, six sliders 50 are provided on a predetermined slider fixing means 47*a*. Note that the number of poles of the general signal slip ring 90 is not particularly limited. However, the number of poles is preferably six or more since the number of the general signal cables of an HDMI cable is six. In case of the HDMI cable, six general signal cables 61*a* are led from the inside of the rotary shaft 72 to the inside of the cable housing portion 46 through the cable through-hole 48 and connected to each of the sliders 50. Consequently, the general signal cables of the signal cables 65*a* of the rotary equipment 3 side are electrically connected to the sliders 50 of the general signal slip ring 90 respectively.

Figure 7:
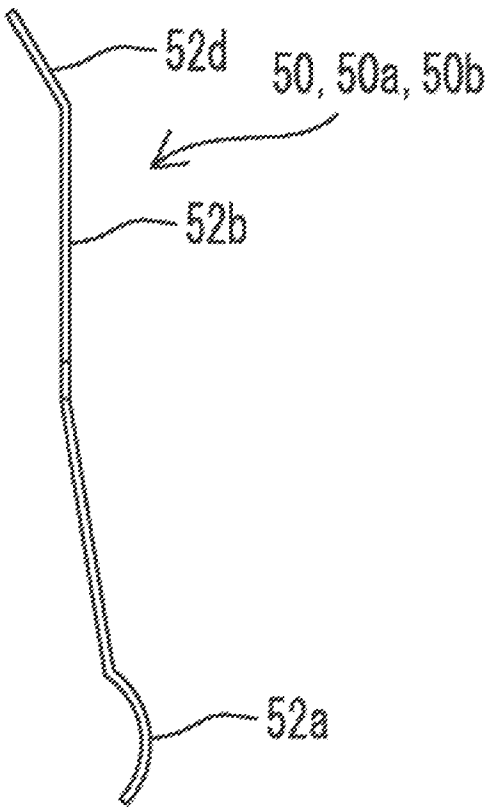
FIG. 7 is a drawing for explaining a slider constituting the present invention.
Figure 7:
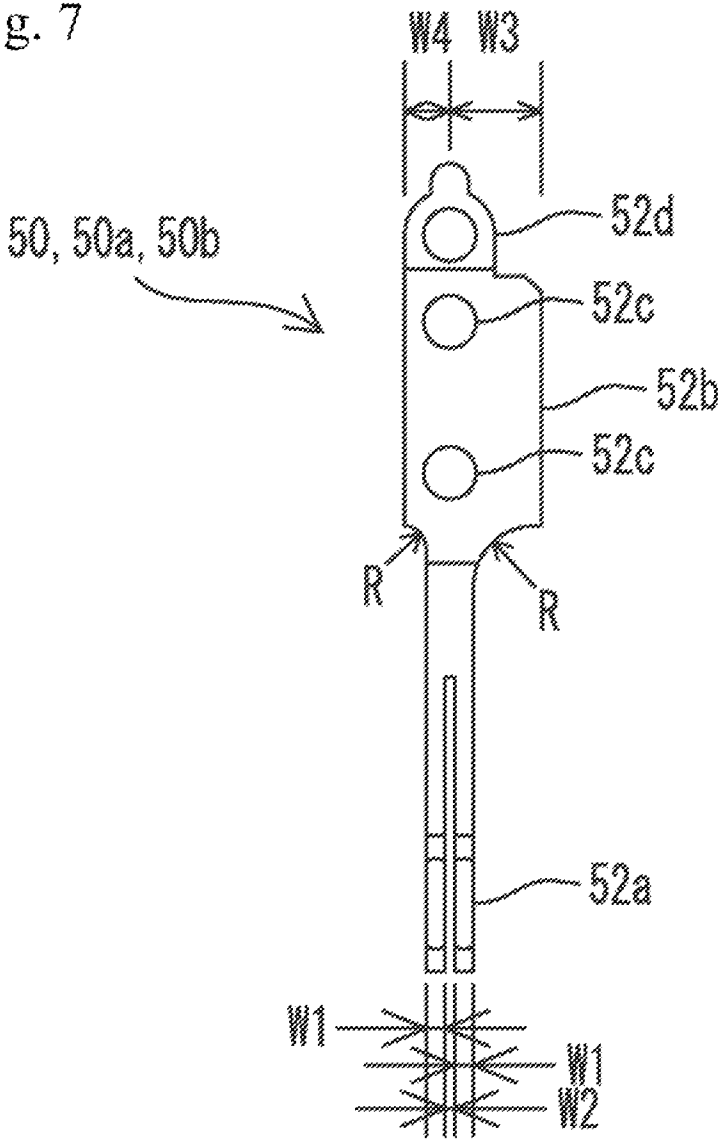
Figure 8A:
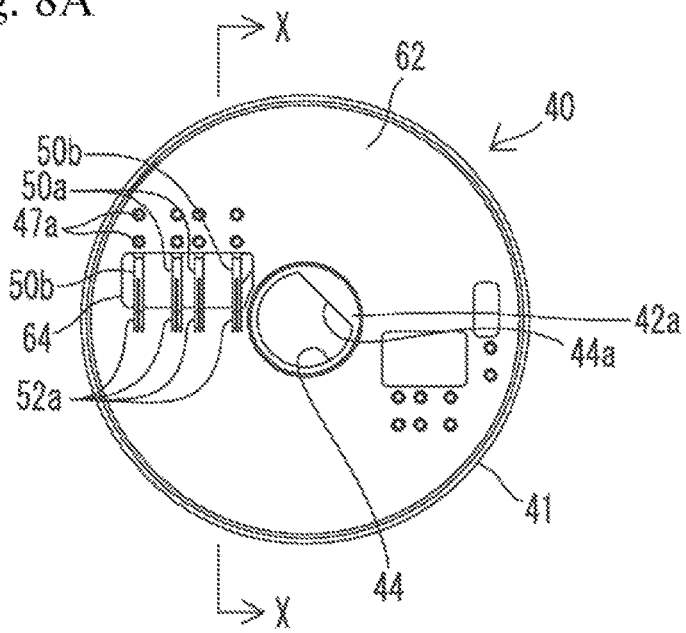
FIGS. 8A to 8D are drawings for explaining a rotor having a cable cover.
Figure 8B:
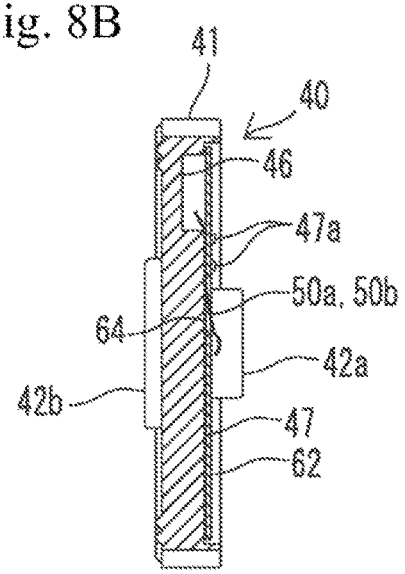
Figure 8C:
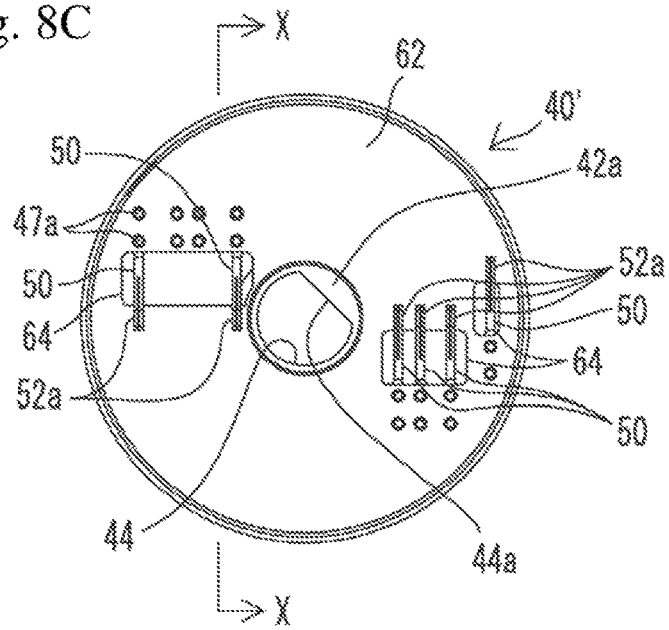
Figure 8D:
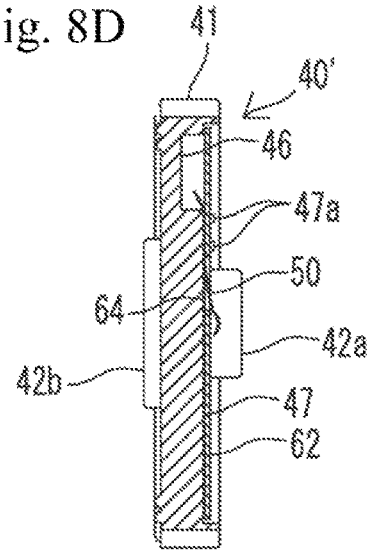

The sliders 50 (differential signal sliders 50*a*, shielding sliders 50*b*) are formed of a metallic thin plate having elasticity. As shown in FIG. 7, the sliders 50 are mainly composed of a sliding portion 52*a* and a fixing piece 52*b*. The sliding portion 52*a* is bent at a predetermined angle with respect to the fixing piece 52*b*. The sliding portion 52*a* is energized toward the base substrate 30 and the general signal base substrate 30' by an elastic force of the bent part. The fixing piece 52*b* is provided with the above described fixing hole 52*c*. At a rear end of the fixing piece 52*b*, a connection terminal 52*d* is provided so that each wiring (general signal cables 61*a*, differential signal lines 60*a*(+), 60*a*(−), shield wires 60*a*(G)) is soldered to the connection terminal 52*d*. A contact point of the sliding portion 52*a* is preferably formed in an arc shape to be protruded upward and bifurcated (divided into two). In particular, in the differential signal sliders 50*a*, the ratio of the terminal width W1 to the terminal interval W2 is preferably 2:1 to suppress the attenuation as much as possible. Note that the terminal width W1 is 0.25 mm and the terminal interval W2 is 0.125 mm in the present example. In particular, since the installation interval between the two differential signal sliders 50*a* is narrow, it is preferred that two kinds of differential signal sliders 50*a* formed symmetrical with each other in the long side direction are manufactured and the length W4 to an inner side (nearer to the other of the pair of differential signal sliders 50*a*) of the fixing piece 52*b* is shorter than the length W3 to an outer side (nearer to the shielding sliders 50*b*). Also in this case, the ratio of W3 to W4 is preferably W3:W4=2:1. Note that high-frequency signal is radiated to a space as electromagnetic field energy due to reflection at a corner part. Accordingly, it is preferable that roundness is formed at the connection part between the sliding portion 52*a* and the fixing piece 52*b* to prevent the reflection of the high-frequency signal.

If floating occurs at the differential signal cables 60*a*, the general signal cables 61*a* and the like housed in the cable housing portion 46, there is a possibility that the cables are in contact with the base substrates 30', 30 side to cause malfunction. Accordingly, as shown in FIGS. 8A to 8D, it is preferred that a cable cover 62 having an opening window 64 for exposing the sliding portion 52*a* of each of the sliders 50, 50*a*, 50*b* is fixed to the installation surface of the sliders of the rotor so that the installation surface of the sliders is covered with the cable cover 62 for preventing the differential signal cables 60*a* (differential signal lines 60*a*(+), 60*a*(−), shield wires 60*a*(G)) from contacting the base substrates 30', 30 side of the general signal cables 61*a*.

Figure 9A:
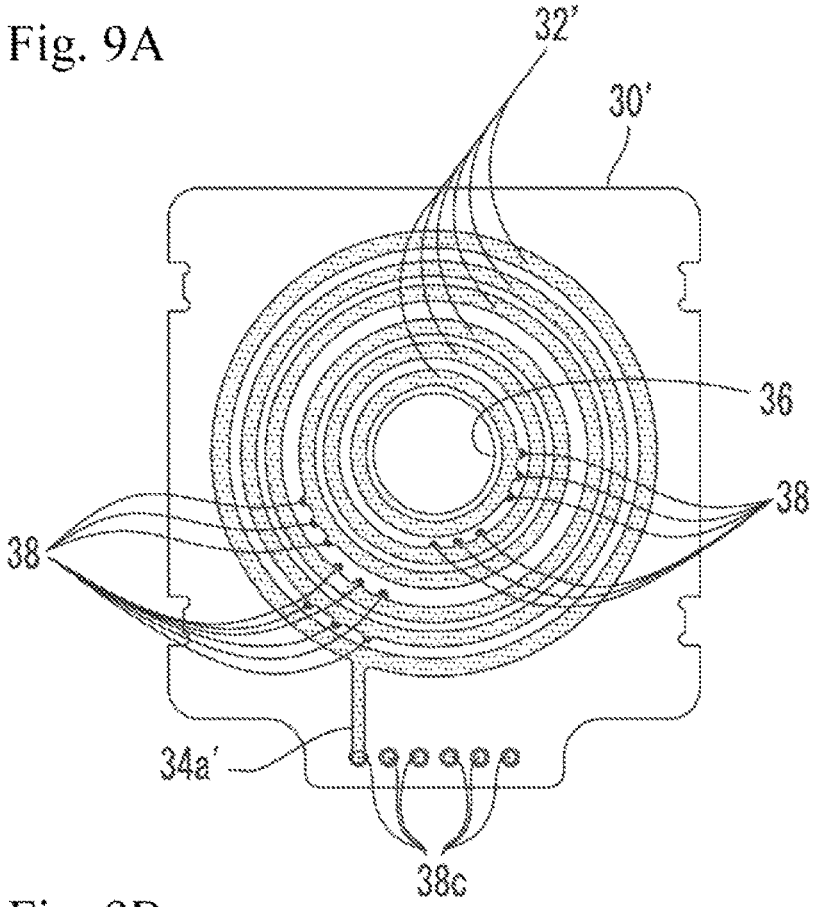
FIGS. 9A and 9B are drawings for explaining a base substrate of the general signal slip ring constituting the present invention.
Figure 9B:
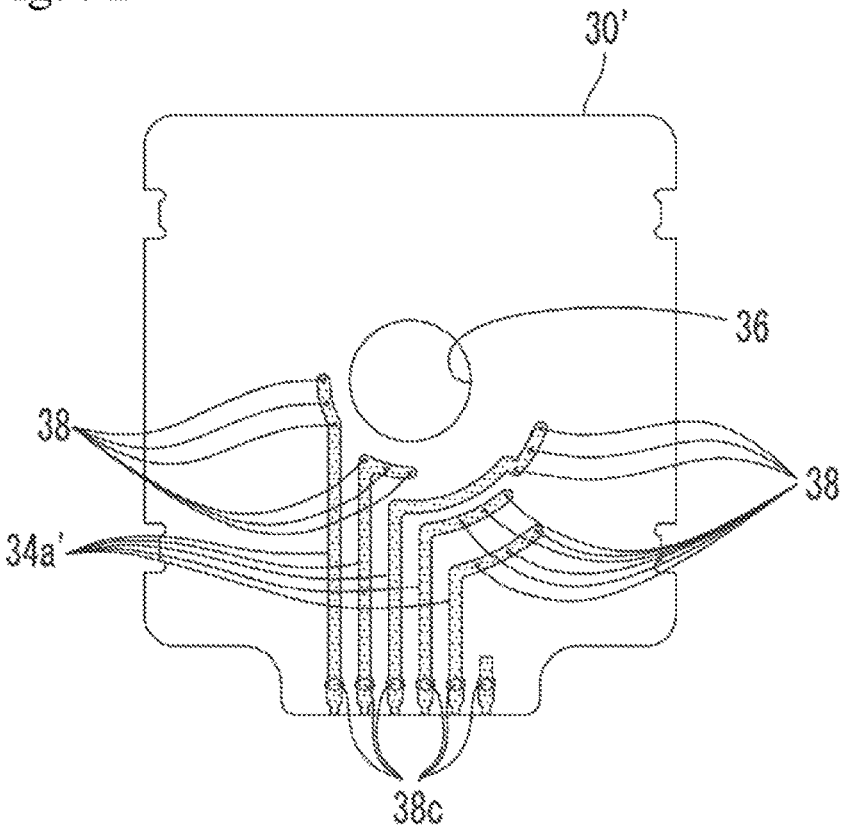

Next, the general signal base substrate 30' of the general signal slip ring 90 will be explained. FIG. 9A is a drawing showing a surface (inner surface) facing the general signal rotor 40' of the general signal base substrate 30' and FIG. 9B is a drawing showing a reverse surface (outer surface) of FIG. 9A. Note that the portion of the electrode is shown as dots in FIGS. 9A, 9B and the later described FIGS. 10A, 10B. The general signal base substrate 30' shown in FIGS. 9A, 9B has the rotor hole 36 at the center part so that the cylindrical shaft 42*a* of the general signal rotor 40' is rotatably fitted into the rotor hole 36. The general signal base substrate 30' has six general signal annular electrodes 32' at the surface facing the general signal rotor 40'. The general signal annular electrodes 32' are concentrically with the rotation axis (rotor hole 36) while the diameters are different from each other. Extraction electrodes 34*a*' are provided on the reverse surface of the general signal base substrate 30' so that the extraction electrodes 34*a*' which correspond to the general signal annular electrodes 32' on one-to-one basis. The extraction electrodes 34*a*' and the general signal annular electrodes 32' are electrically connected through through-holes 38 formed on the general signal base substrate 30'. Note that the through-holes 38 are preferably formed in a relatively peripheral portion of the general signal annular electrodes 32' to avoid the contact with the sliders 50. In the above described structure, the sliders 50 are not affected by the step located at the portion of the through-holes 38 when the sliders 50 are slid. Thus, operational stability can be improved and life time of the components can be extended. The extraction electrodes 34*a*' are connected to the general signal cables 61*b* of the stationary portion 1 side directly or through a not-illustrated connector. From the viewpoint of downsizing, the extraction electrodes 34*a*' are preferably connected to the general signal cables 61*b* through through-holes 38*c* at the surface facing the rotor (inner surface). Consequently, the general signal cables of the stationary portion 1 side are electrically connected to the general signal annular electrodes 32' respectively via the general signal cables 61*b*.

Figure 10A:
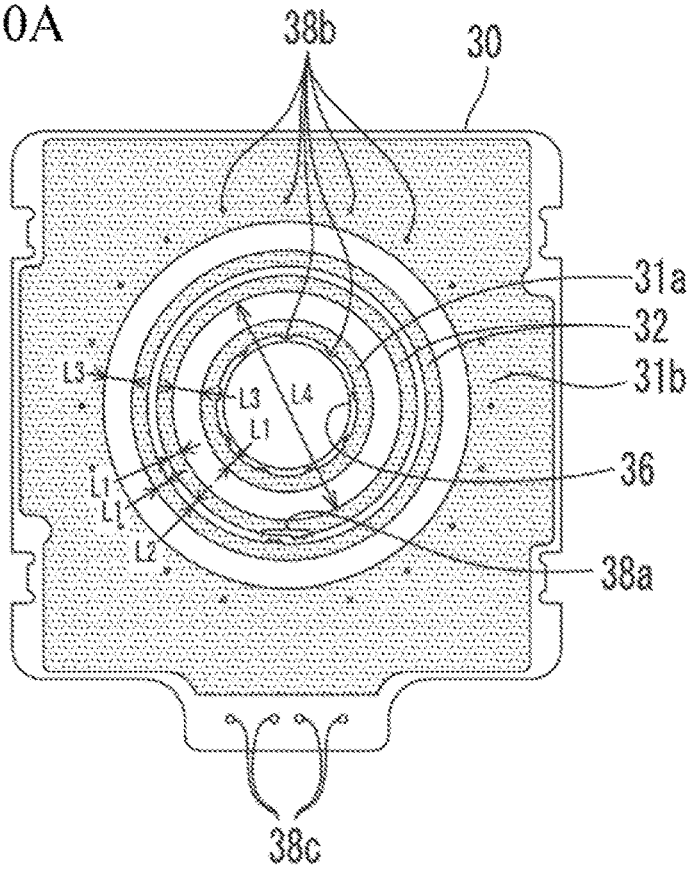
FIGS. 10A and 10B are drawings for explaining a base substrate of the differential signal slip ring constituting the present invention.
Figure 10B:
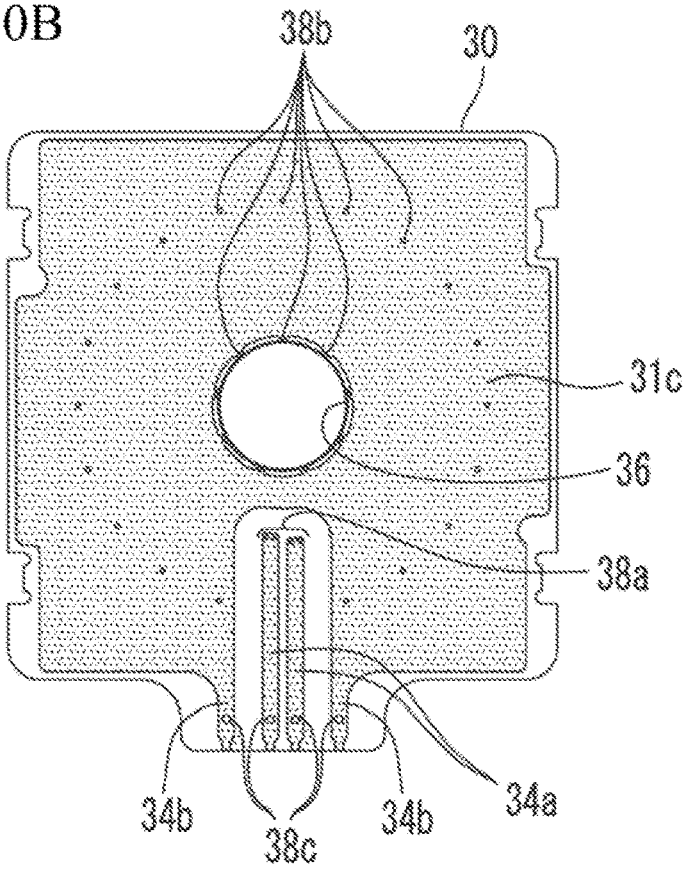

Next, the base substrate 30 of the differential signal slip rings 70 will be explained. FIG. 10A is a drawing showing a surface (inner surface) facing the rotor 40 of the base substrate 30 and FIG. 10B is a drawing showing a reverse surface (outer surface) of FIG. 10A. Similar to the above described general signal base substrate 30', the base substrate 30 shown in FIGS. 10A, 10B has the rotor hole 36 at the center part so that the cylindrical shaft 42*a* of the rotor 40 is rotatably fitted into the rotor hole 36. As shown in FIG. 10A, the base substrate 30 has two annular electrodes 32 at the surface facing the rotor 40. The annular electrodes 32 are concentrically with the rotation axis (rotor hole 36) while the diameters are different from each other. A first shield electrode 31*a* is formed on the inner peripheral side (nearer to the rotor hole 36) than the two annular electrodes 32. A second shield electrode 31*b* is formed on the outer peripheral side than the annular electrodes 32. Note that the second shield electrode 31*b* is preferably formed in as large a range as possible to prevent the transmission/reception of noise. It is preferred that the second shield electrode 31*b* approximately entirely covers a blank space of the base substrate 30 at the surface facing the rotor.

As shown in FIG. 10B, extraction electrodes 34*a* corresponding to the annular electrodes 32 on one-to-one basis and the third shield electrode 31*c* approximately entirely covering a blank space of the reverse surface side are formed on the reverse surface side of the base substrate 30. The annular electrodes 32 are electrically connected to the extraction electrodes 34*a* through through-holes 38*a* formed on the base substrate 30. Similarly, the first shield electrode 31*a* and the second shield electrode 31*b* are electrically connected to the third shield electrode 31*c* through through-holes 38*b* formed on the base substrate 30. The third shield electrode 31*c* is connected to shielded extraction electrodes 34*b* provided on the left and right of the extraction electrodes 34*a*. Note that the through-holes 38*a*, 38*b* are preferably formed in the peripheral portion or the like to avoid the contact with the differential signal sliders 50*a* and the shielding sliders 50*b*. In the above described structure, the differential signal sliders 50*a* and the shielding sliders 50*b* are not affected by the step located at the portion of the through-holes 38*a*, 38*b* when the differential signal sliders 50*a* and the shielding sliders 50*b* are slid. Thus, operational stability can be improved and life time of the components can be extended. The extraction electrodes 34*a* are connected to differential signal lines 60*b*(+), 60*b*(−) of the differential signal cables 60*b* directly or through a not-illustrated connector. The shielded extraction electrodes 34*b* are connected to the shield wires 60*b*(G) of the differential signal cables 60*b* directly or through a not-illustrated connector. From the viewpoint of downsizing, the shielded extraction electrodes 34*b* are preferably connected to the differential signal cables 60*b* through the through-holes 38*c* at the surface facing the rotor (inner surface). Consequently, the differential signal lines and the shield wires of the stationary portion 1 side are electrically connected to the annular electrodes 32 and the first and second shield electrodes 31*a*, 31*b* respectively.

Figure 11:
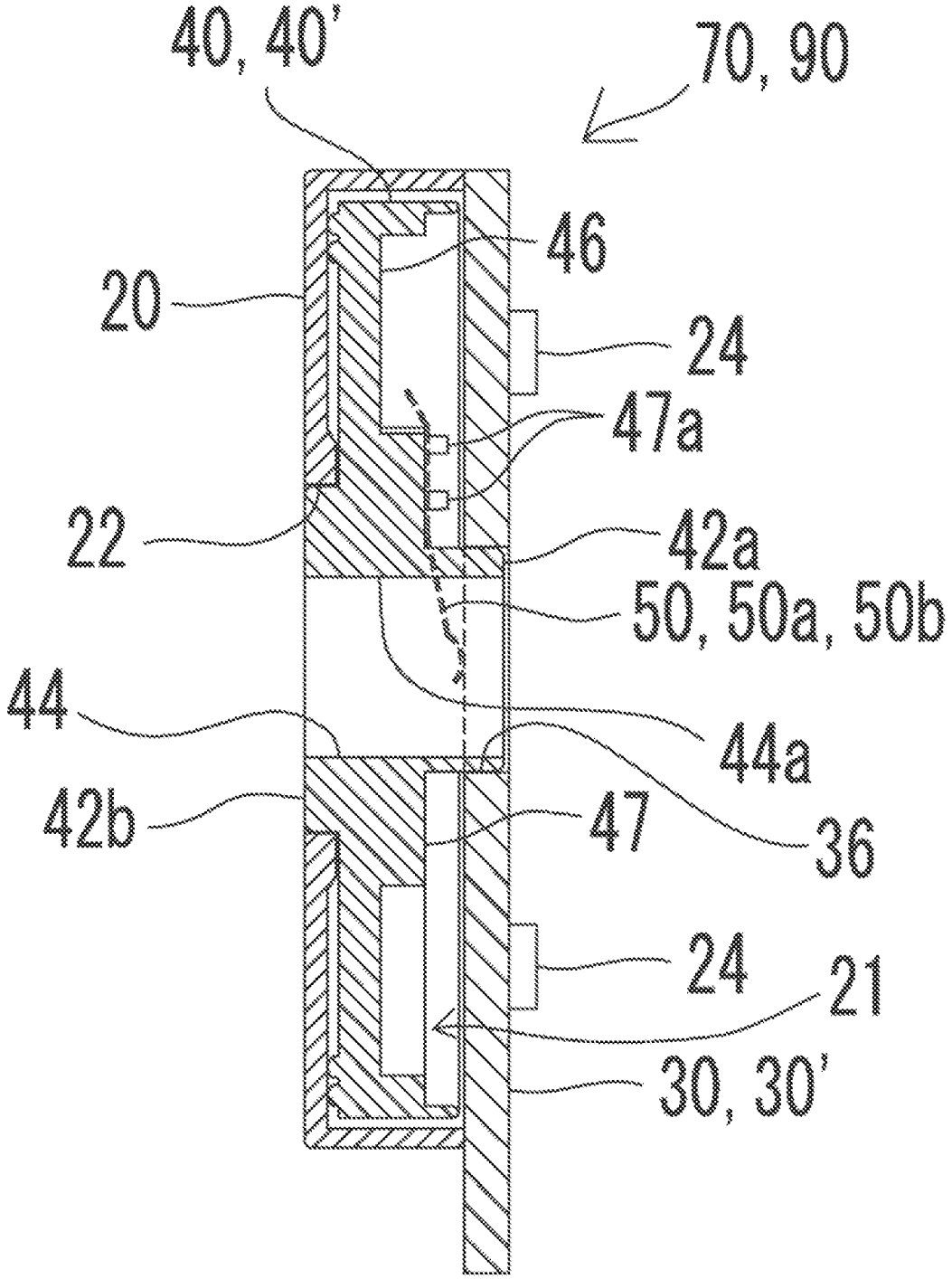
FIG. 11 is a schematic-cross sectional view of the differential signal slip ring and the general signal slip ring constituting the present invention.

In the differential signal slip rings 70 and the general signal slip ring 90, as shown in FIG. 11, the rotor 40 and the general signal rotor 40' are housed in the rotor housing portion 21 of the case portion 20 and the opening side of the case portion 20 is closed by the base substrate 30 or the general signal base substrate 30'. Consequently, the cylindrical shaft 42*b* is rotatably supported by the rotor bearing 22 of the case portion 20. The cylindrical shaft 42*a* of the rotor 40 and the general signal rotor 40' is rotatably supported by the rotor hole 36 of the base substrate 30 and the general signal base substrate 30'. Consequently, the rotor 40 and the general signal rotor 40' are rotatably held in the case portion 20. At this time, the sliding portion 52*a* of the sliders 50*a*, 50*b* of the rotor 40 is in contact with the corresponding annular electrodes 32, first shield electrode 31*a* and second shield electrode 31*b* by a predetermined elastic force. Thus, these electrodes (annular electrodes 32, first shield electrode 31*a*, second shield electrode 31*b*) are electrically connected to the sliders (differential signal sliders 50*a*, shielding sliders 50*b*) respectively. The sliding portion 52*a* of the sliders 50 of the general signal rotor 40' is in contact with the corresponding general signal annular electrodes 32' by a predetermined elastic force. Thus, the general signal annular electrodes 32' are electrically connected to the sliders 50 respectively.

When the rotary means 5 is rotationally operated to rotate the rotary shaft 72, the rotor 40 and the general signal rotor 40' are rotated in the case portion 20. At this time, the sliders 50*a*, 50*b* of the rotor 40 are rotated while keeping the electrical contact with the corresponding annular electrodes 32, first shield electrode 31*a* and second shield electrode 31*b*. In addition, the sliders 50 of the general signal rotor 40' are rotated while keeping the electrical contact with the general signal annular electrodes 32'. Accordingly, even when the rotary equipment 3 is continuously rotated through 360 degrees, the signal transmission between the rotary equipment 3 and the device 8 is maintained.

In the slip ring 100 of the presentation, although downsizing is possible since the annular electrodes 32 are used, influence of reflection and attenuation of signals is large compared to a linear parallel electric path. Therefore, for transmitting the low voltage differential signal of 0.35V adopted in the video signals of 4K resolution, it is particularly important for suppressing the loss in the base substrate 30 (annular electrodes 32). Specifically, it is important to make the characteristic impedance of the base substrate 30 closer to 100Ω which is the characteristic impedance of a transmission line and make the frequency of the resonance point (bottom of attenuation) move to higher than 1.5 GHz which is the band to be used to suppress the insertion loss in the band of 1.5 GHz.

The dimension of the electrode pattern, the thickness of the substrate, electric permittivity and the like affect matching of the characteristic impedance and high frequency processing at the resonance point. Since the slip ring 100 is preferably small size, the base substrate 30 having an outer dimension of 35 mm×35 mm is used. The above described size is relatively small in the base substrate for the slip ring. In this case, the diameter of the rotary shaft 72 is φ7 mm and the diameter of the rotor hole 36 is approximately φ8 mm. The width L1 of the annular electrodes 32 and the first shield electrode 31*a* shown in FIG. 10A is 1 mm for enabling the electrical contact with the sliders 50 stably. When the width L1 of the annular electrodes 32 is specified to 1 mm, an interval L2 between the annular electrodes 32 is preferably approximately one half of the width L1. The interval L2 is specified to 0.6 since the result of the simulation was good. When the interval L2 between the annular electrodes 32 is specified to 0.6 mm, an interval L3 between the annular electrodes 32 and the first and second shield electrodes 31*a*, 31*b* is specified to 1.8 mm which is three times longer than the interval L2 since the result of the simulation was good. In this case, the innermost diameter L4 of the annular electrodes 32 is 14.6 mm. Since the base substrate is preferably thicker for the characteristic impedance from the result of the simulation, the substrate having a thickness of 1.6 mm is used. The above described thickness is relatively thick in the generally used substrates.

Here, the differential signal slip rings 70 having the electrode pattern (annular electrodes 32, shield electrodes 31*a*, 31*b*, 31*c*) of the above described dimension were produced using a glass epoxy substrate having the relative permittivity Er=4.5 and thickness of 1.6 mm for the base substrate 30 to measure attenuation characteristic and the characteristic impedance of the base substrate 30. As a result, the characteristic impedance of the base substrate 30 was 55Ω. The resonance point frequency was approximately 1.8 GHz and the insertion loss at 1.5 GHz was approximately −24 dB.

Figure 12:
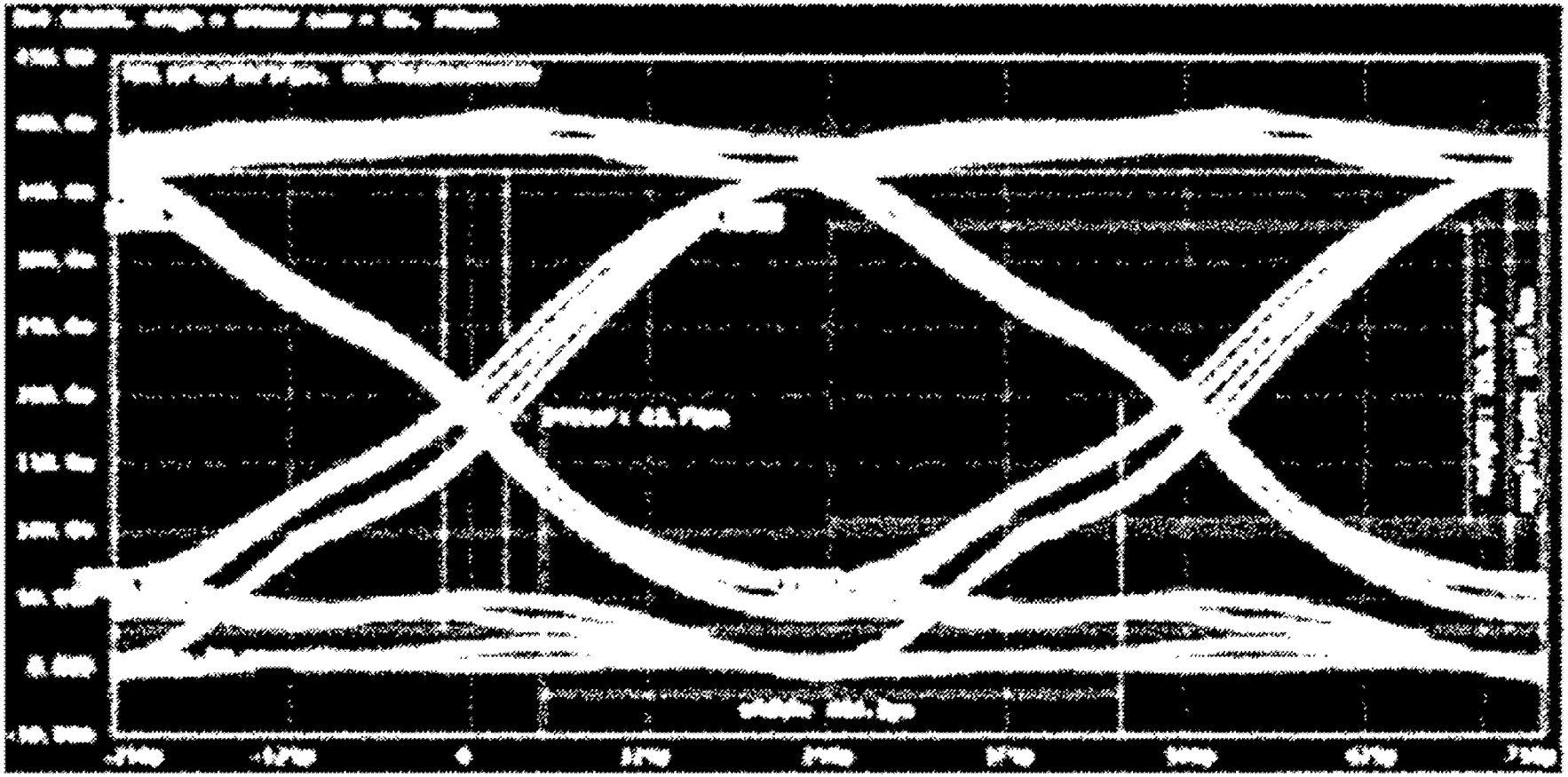
FIG. 12 is a drawing showing a measurement result of an eye opening of the slip ring concerning the present invention.

Next, the base substrate 30 was produced by changing the material of the substrate using the base substrate 30 having the relative permittivity Er=3.1 (substrate: polyphenylene ether) and the base substrate 30 having the relative permittivity Er=2.2 (substrate: polytetrafluoroethylene and micro glass fiber). The differential signal slip rings 70 were similarly produced by using the above described base substrates 30 to measure attenuation characteristic and the characteristic impedance of the base substrates 30. As a result, in the base substrate 30 having the relative permittivity Er of 3.1, the characteristic impedance was increased to 59Ω, the resonance point frequency was shifted to approximately 2.0 GHz, and the insertion loss at 1.5 GHz was reduced to −19 dB. In the base substrate 30 having the relative permittivity Er of 2.2, the characteristic impedance was further increased to 70Ω, the resonance point frequency was shifted to approximately 2.3 GHz, and the insertion loss at 1.5 GHz was further reduced to −13 dB. The characteristic of the differential signal slip rings 70 using the base substrate 30 having the relative permittivity Er of 2.0 was almost same as the characteristic using the base substrate 30 having the relative permittivity Er of 2.2. Accordingly, it can be said that the relative permittivity Er of the base substrate 30 is preferably approximately 2.0 to 2.5. In particular, the substrate of polytetrafluoroethylene and micro glass fiber having the relative permittivity Er of 2.2 is most preferably used. Next, the eye pattern was measured for the signal of 2 Gbps and the amplitude of 200 mV in the differential signal slip rings 70 using the base substrate 30 having the relative permittivity Er of 2.2. As shown in FIG. 12, it can be understood that an eye opening was opened clearly and there was no problem for the transmission characteristic.

When the slip ring 100 of the present invention is formed by the differential signal slip rings 70 using the above described base substrate 30 and the video signal (video size: 3842×2160, bit rate: maximally 72 Mbps/VBS, frame rate: 30 fbs) was transmitted from the 4K camera as the rotary equipment 3 while the 4K camera was rotated. As a result, the video signal could be reproduced on the device 8 without causing problem.

Figure 13:
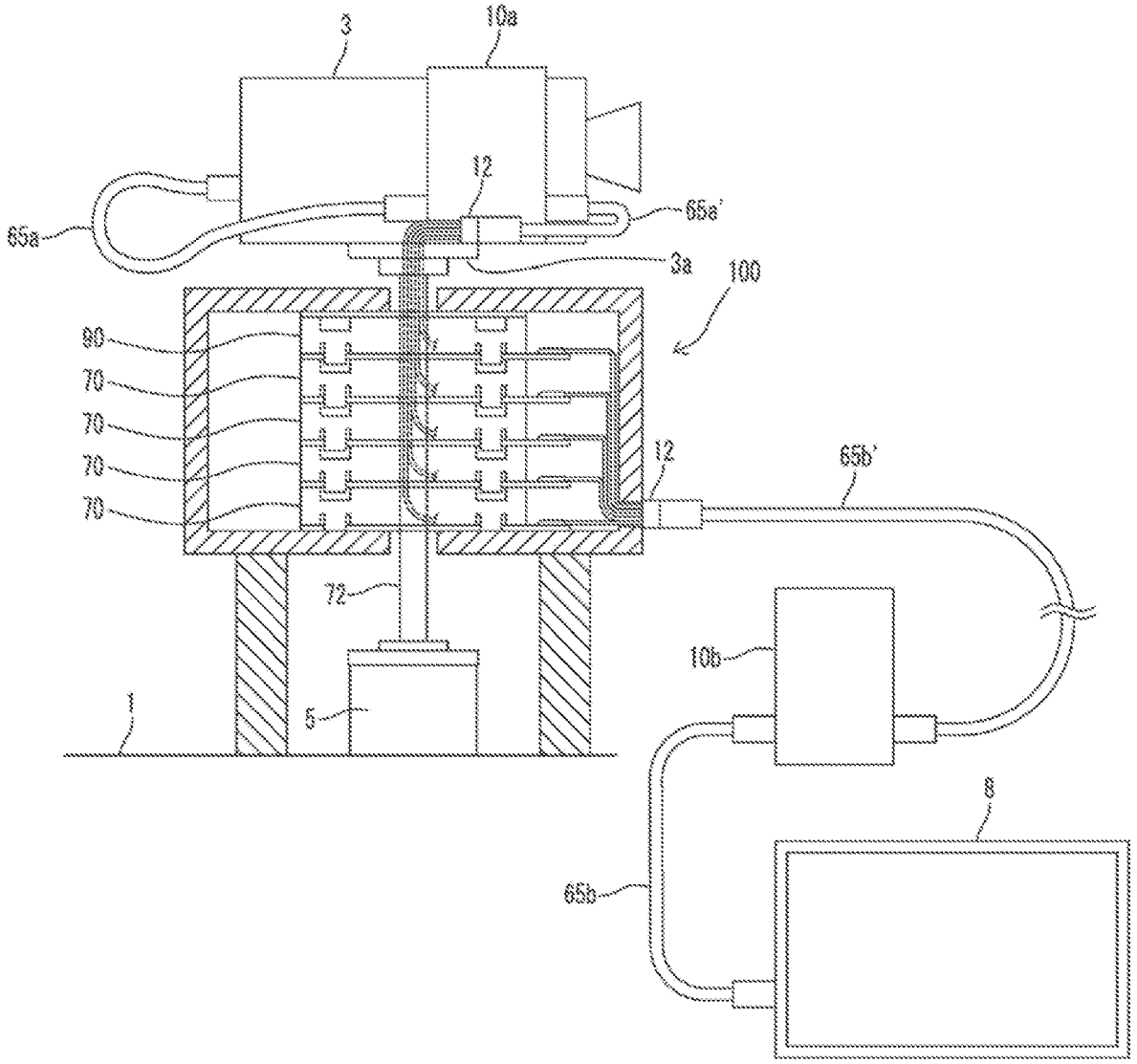
FIG. 13 is a schematic configuration diagram showing a usage example of the slip ring using LAN signal concerning the present invention.

Note that the slip ring 100 of the present invention can be also applied to other differential signals than the low voltage differential signal of HDMI. For example, the slip ring 100 of the present invention can be applied to LAN signal. Accordingly, the slip ring 100 of the present invention can be also applied to an IP camera and the like, for example. Furthermore, when the distance between the rotary equipment 3 and the device 8 is far and it is difficult to transmit the signals by the system of the low voltage differential signal of HDMI, it is possible to provide an HDMI-LAN conversion unit 10*a* for converting the HDMI signal into the LAN signal between the rotary equipment 3 and the slip ring 100 and provide a LAN-HDMI conversion unit 10*b* for converting the LAN signal into the HDMI signal on the device 8 side as shown in FIG. 13 to transmit the video signals as the differential signals of LAN. In this case, LAN cables 65*a*', 65*b*' are connected to the slip ring 100.

As described above, in the slip ring 100 of the present invention, the differential signal slip rings 70 are formed using the base substrate 30 where the electrode pattern and the relative permittivity are optimized to transmit the signal by using one differential signal slip ring 70 to one differential signal cable 60*a*. Consequently, the low voltage differential signal of 0.35V adopted in the video signals of 4K resolution can be transmitted. As a result, the videos can be recorded by the high-resolution 4K camera while the camera is continuously rotated through 360 degrees.

The slip ring 100 shown in the above described embodiment is merely an example. The shapes, dimensions, mechanisms, electrode patterns, wiring paths and the like of the differential signal slip rings 70, the general signal slip ring 90 and other portions can be changed when performing the present invention without departing from the scope of the present invention.

DESCRIPTION OF THE REFERENCE NUMERALS

1: stationary portion, 3: rotary equipment, 30: base substrate, 31*a*: first shield electrode, 31*b*: second shield electrode, 31*c*: third shield electrode, 32: annular electrode, 40: rotor (for differential signal), 40': general signal rotor, 44: shaft hole, 48: cable through-hole, 50*a*: differential signal slider, 50*b*: shielding slider, 52*a*: sliding portion, 60*a*, 60*b*: differential signal cable, 60*a*(+), 60*a*(−), 60*b*(+), 60*b*(−): differential signal line, 60*a*(G), 60*b*(G): shield wire, 62: cable cover, 64: opening window, 70: differential signal slip ring, 72: rotary shaft, 90: general signal slip ring, 100: slip ring

The invention claimed is:

1. A slip ring installed between a rotary equipment and a stationary portion, the slip ring comprising:

a rotary shaft fixed to the rotary equipment at one end of the rotary shaft; and four differential signal slip rings, the rotary shaft being inserted through the slip rings, wherein each of the differential signal slip rings includes:

a rotor configured to be rotated by the rotary shaft, the rotor having a pair of differential signal sliders and two shielding sliders; and a base substrate having a pair of annular electrodes formed concentrically with a rotation axis of the rotor, a first shield electrode formed on an inner peripheral side than the annular electrodes and a second shield electrode formed on an outer peripheral side than the annular electrodes, a pair of first differential signal lines of first differential signal cables connected from the rotary equipment are electrically connected to the pair of differential signal sliders, first shield wires of the first differential signal lines are electrically connected to the shielding sliders, a pair of second differential signal lines of second differential signal cables connected from the stationary portion are electrically connected to the pair of annular electrodes, second shield wires of the second differential signal lines which are connected to the annular electrodes are electrically connected to the first shield electrode and the second shield electrode, and the pair of differential signal sliders is configured to be electrically connected to the pair of annular electrodes and the shielding sliders are configured to be electrically connected to the first shield electrode and the second shield electrode so that a differential signal of one of the differential signal cables is transmitted via one of the differential signal slip rings.

2. The slip ring according to claim 1, wherein a cable through-hole is provided in a shaft hole of the rotation axis of the rotor, the first differential signal cables connected from the rotary equipment are led in the rotor through an inside of the rotary shaft and the cable through-hole, and the first differential signal cables are connected to the differential signal sliders and the shielding sliders.

3. The slip ring according to claim 2, further comprising:

an opening window for exposing sliding portions of the differential signal sliders and the shielding sliders; and a cable cover fixed to the rotor for preventing the first differential signal cables from contacting the base substrate.

4. The slip ring according to claim 1, wherein when a first interval is defined as the interval between the annular electrodes and a second interval is defined as the interval between one of the annular electrodes formed on the inner peripheral side and the first shield electrode formed on the inner peripheral side or the interval between the other of the annular electrodes formed on the outer peripheral side and the second shield electrode formed on the outer peripheral side, the second interval is three times longer than the first interval.

5. The slip ring according to claim 1, wherein the second shield electrode covers a blank space of the base substrate approximately entirely, a third shield electrode covering a reverse surface of the base substrate approximately entirely is provided, and the second shield electrode and the first shield electrode are connected to the third shield electrode.

6. The slip ring according to claim 1, further comprising:

a general signal slip ring having a general signal rotor rotated by the rotary shaft.

* * * * *